US007543422B2

(12) United States Patent
Tomczak

(10) Patent No.: US 7,543,422 B2
(45) Date of Patent: Jun. 9, 2009

(54) SIDING INSTALLATION TOOL

(76) Inventor: Raymond Tomczak, 2323 New Hope St., Norristown, PA (US) 19401

( * ) Notice: Subject to any disclaimer, the term of this patent is extended or adjusted under 35 U.S.C. 154(b) by 434 days.

(21) Appl. No.: 11/166,580

(22) Filed: Jun. 24, 2005

(65) Prior Publication Data

US 2006/0010828 A1 Jan. 19, 2006

Related U.S. Application Data

(60) Provisional application No. 60/588,162, filed on Jul. 15, 2004.

(51) Int. Cl.

| | |
|---|---|
| ***E04G 21/14*** | (2006.01) |
| ***E04G 21/04*** | (2006.01) |
| ***E04G 23/00*** | (2006.01) |
| ***E04D 1/00*** | (2006.01) |
| ***E04F 21/00*** | (2006.01) |
| ***G01D 21/00*** | (2006.01) |

(52) U.S. Cl. ..... 52/749.11; 33/649; 33/648; 52/749.12; 52/127.1; 52/127.2; 52/514; 52/520

(58) Field of Classification Search ..... 52/749.11, 52/749.12, 748.1, 127.1, 127.2, 514, 520, 52/105; 33/647–649, 640, 411; 269/904
See application file for complete search history.

(56) References Cited

U.S. PATENT DOCUMENTS

| | | | | | |
|---|---|---|---|---|---|
| 328,661 | A | * | 10/1885 | Dunbar et al. | 33/647 |
| 351,722 | A | * | 10/1886 | Trueblood | 33/647 |
| 377,085 | A | * | 1/1888 | Russell | 33/647 |
| 3,133,357 | A | | 5/1964 | Gayan | |
| 3,463,480 | A | | 8/1969 | Edstrom | |
| 3,490,152 | A | * | 1/1970 | Printz | 33/649 |
| 3,518,770 | A | | 7/1970 | Cromleigh | |
| 3,904,184 | A | | 9/1975 | Krueger | |
| 4,159,029 | A | | 6/1979 | Matthews | |
| 4,164,346 | A | | 8/1979 | Sickler | |
| 4,314,429 | A | | 2/1982 | Casteel et al. | |
| 4,356,673 | A | | 11/1982 | Gailey | |
| 4,425,714 | A | | 1/1984 | Kelly | |
| 4,484,392 | A | * | 11/1984 | DeFino et al. | 33/647 |
| 4,937,950 | A | * | 7/1990 | Farnworth | 33/646 |
| 5,290,019 | A | | 3/1994 | Beyers | |
| 5,291,719 | A | | 3/1994 | Buster | |
| 5,319,909 | A | | 6/1994 | Singleterry | |
| 5,370,377 | A | * | 12/1994 | Van Der Meer | 269/43 |
| 5,400,519 | A | | 3/1995 | Meyer | |
| 5,465,499 | A | | 11/1995 | LaPante | |
| 5,522,149 | A | | 6/1996 | Meyer | |
| 5,623,767 | A | | 4/1997 | Colavito | |
| 5,692,311 | A | * | 12/1997 | Paquin | 33/647 |
| D406,069 | S | * | 2/1999 | Boyce | D10/64 |

(Continued)

*Primary Examiner*—Richard E Chilcot, Jr.
*Assistant Examiner*—Mark R Wendell
(74) *Attorney, Agent, or Firm*—RatnerPrestia

(57) ABSTRACT

A lap siding installation device for spacing and applying lap siding to a surface. Anchoring mechanisms are provided for releasably anchoring the device to a surface, and connection mechanisms are also provided to house the anchoring mechanisms. A first elongate member and a second elongate member extend from the connection mechanism in substantially the same direction. The second elongate member has a length greater than the first elongate member, and includes a protrusion with a ledge to receive and hold a piece of lap siding between the first and second elongate members. Methods are also included for spacing and applying lap siding to a surface.

22 Claims, 11 Drawing Sheets

U.S. PATENT DOCUMENTS

| | | | | |
|---|---|---|---|---|
| D457,405 | S | 5/2002 | White | |
| 6,494,016 | B1 | 12/2002 | Bankson | |
| 6,640,512 | B1 | 11/2003 | Kinnaman et al. | |
| 6,684,521 | B2 | 2/2004 | Rempe | |
| 6,705,021 | B2 | 3/2004 | Nadal et al. | |
| 2002/0170198 | A1 | 11/2002 | Rempe | |
| 2003/0014877 | A1 | 1/2003 | Nadal et al. | |
| 2004/0221467 | A1 * | 11/2004 | Chillington | 33/649 |

* cited by examiner

SIDING INSTALLATION TOOL

This application claims priority of U.S. Provisional Patent Application Ser. No. 60/588,162 filed Jul. 15, 2004.

FIELD OF INVENTION

The present invention relates to construction tools, and more specifically, to a tool for spacing and applying siding to a surface.

BACKGROUND OF THE INVENTION

Lap siding is a common type of siding for buildings. Lap siding refers generally to siding in which multiple pieces of siding are attached to a building in a partially overlapping fashion. More specifically, a first piece is attached at the lower extent of the face of the building to be sided and then additional pieces are attached above it, with each additional piece at least partially overlapping the piece below it.

Siding panels used on buildings often are long and unwieldy. Siding panels can be very cumbersome to handle and to maneuver into a desired position on the building. In many situations, it requires two or more workers to maneuver a siding panel into a desired position and then to fix that panel to the building. Still further, it may be difficult for a worker to manipulate tools while supporting a siding panel. Again, the worker generally requires assistance. Such situations can be very wasteful of time and resources.

SUMMARY OF THE INVENTION

The present invention relates to a lap siding installation device for spacing and applying lap siding to a surface. Anchoring means is provided for releasably anchoring the device to a surface, and connection means is also provided to house the anchoring means. A first elongate member and a second elongate member extend from the connection means in substantially the same direction. The second elongate member has a length greater than the first elongate member, and includes a protrusion with a ledge to receive and hold a piece of siding between the first and second elongate members.

Also included as part of the present invention are methods for spacing and applying lap siding to a surface. The methods include placing and fastening a strip of lap siding to surface. In so doing, the bottom edge of the back spacer member is aligned to the strip of siding, and the device is anchored to the surface by the anchoring means. A second strip of lap siding is then slid between the back spacer member and the support member so that the strip rests on a ledge of the support member. The second strip of siding is fastened to the surface, and the device is removed from the surface.

BRIEF DESCRIPTION OF THE DRAWINGS

The features of the invention and the elements characteristic of the invention are set forth with particularity in the appended claims. The figures are for illustration purposes only and are not necessarily drawn to scale. The invention itself, however, may best be understood by reference to the detailed description which follows when taken in conjunction with the accompanying drawing in which:

DETAILED DESCRIPTION OF THE INVENTION

Figure 1:
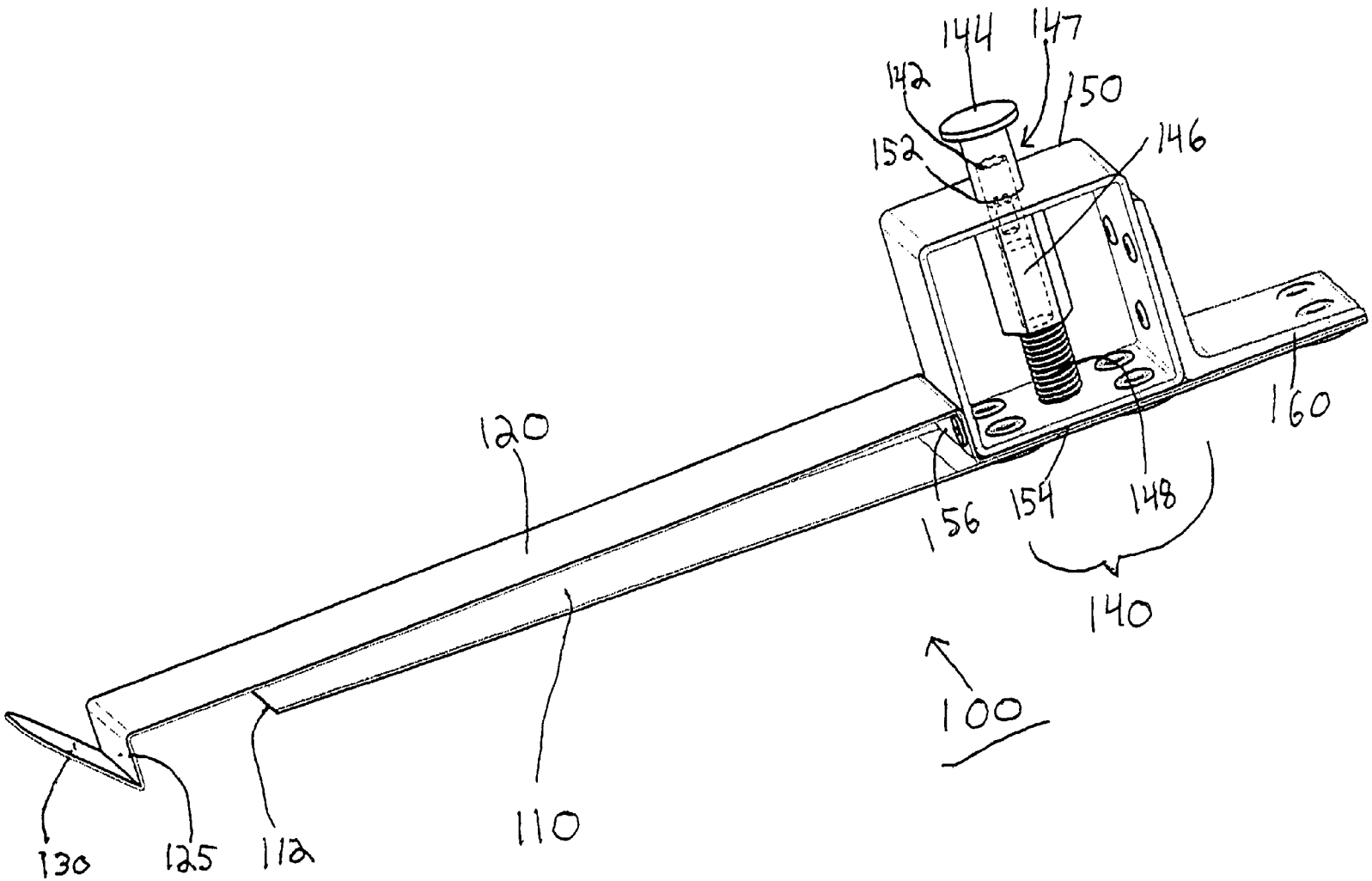
FIG. 1 is a perspective view of an embodiment of a tool in accordance with the present invention for installation of lap siding.

FIG. 1 depicts one embodiment of the siding installation tool of the present invention. Specifically, FIG. 1 shows siding tool 100 having a first elongate member, namely back spacer member (also referred as back gauge) 110, and a second elongate member, namely support member 120. Support member 120, in this embodiment, has a ledge 125 which extends in the direction of back spacer member 110. Also shown is tab 130 which extends from support member 120 in a direction away from back spacer member 110. It can be seen that back spacer member 110 and support member 120 together define a space which is sized to receive a piece of lap siding for which hanging is desired. The end of back spacer member 110 closest to ledge 125 has a bottom edge 112. Edge 112 is used to space the overlapping pieces of siding.

Also shown in FIG. 1 is connection means 140. In this embodiment, connection means 140 comprises a support bracket that houses an anchoring means. The anchoring means is comprised of a spike 142 having head 144. Spike 142 extends through support bracket 150. In this embodiment, support bracket 150 is rectangular and spike 142 extends through two holes in support bracket 150. In an alternative embodiment, a support bracket could take a different form, such as an L-shape, U-shape, or other suitable structure to support a spike or other anchoring means. It is only necessary that whatever connection means is selected, it be mechanically coupled to back spacer member 110 and support member 120. Both the connection means and the support member must be structurally adequate to support at least a desired weight, such as a portion of a piece of lap siding. As such, the connection means, the support member, as well as the back spacer member can be fashioned from a polymer or metal of sufficient mechanical strength. Such materials would include carbon or stainless steel, alloys of various types known to those skilled in the art, and polymeric, plastic, or resinous materials having adequate strength. The manufacture of the device would be determined in accordance with the materials selected, and it should be noted that a combination of material could be used, such as aluminum spacer and support members, a plastic support bracket, and a stainless steel spike used for anchoring. Other combinations could be determined by one skilled in the art having the benefit of this disclosure.

Figure 2:
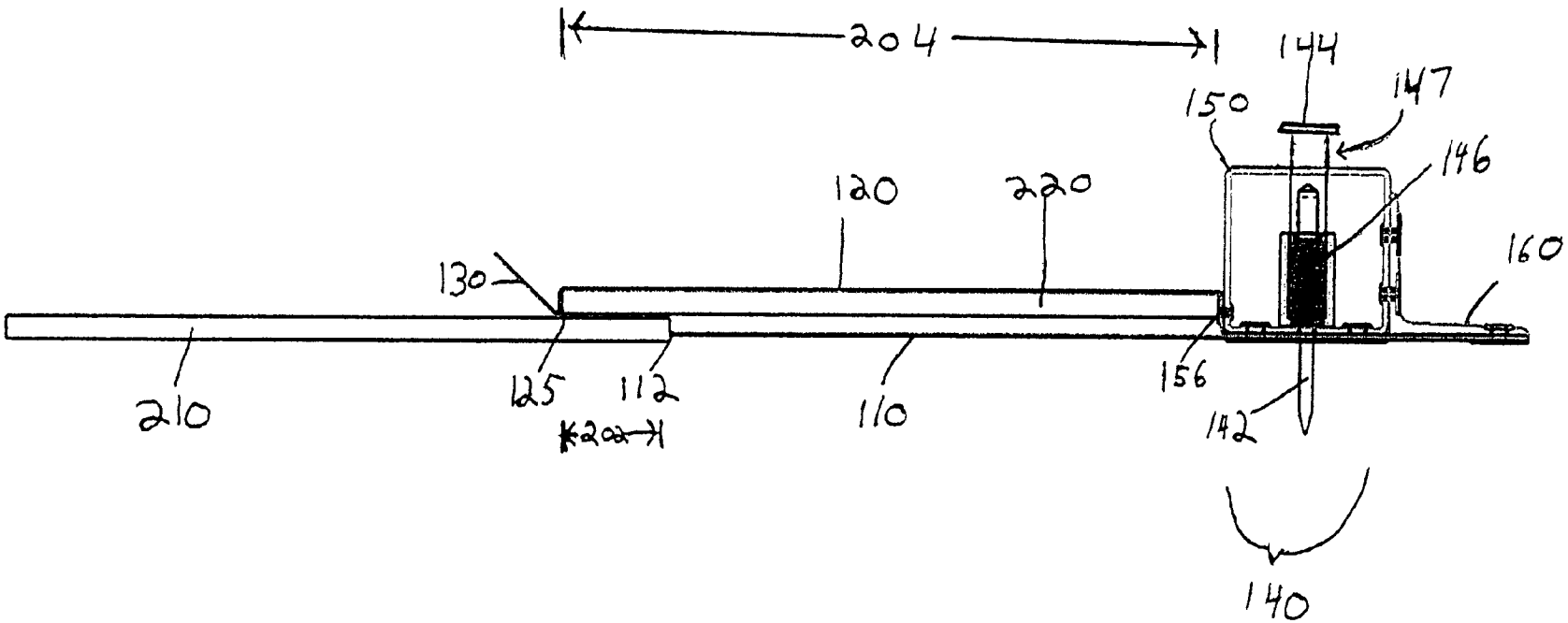
FIG. 2 is a side view of the tool in use with a spike extended.

In the embodiment shown in FIG. 1, spike 142 is housed in support bracket 150. Spike 142 passes through aperture 152 in the top support bracket 150 and through aperture 154, which goes through the bottom of support bracket 150, the top of back spacer member 110, and support member 120. Also attached to the spike is spike stop 146, which stops the spike from fully extending through apertures 152 and 154 (in addition to head 144). Furthermore, spike stop 146 allows a gap 147 to be left between the side of support bracket 150 and spike head 144 when the spike is in its inward position (such as is shown in FIG. 2). Spring 148 is disposed around spike 142 between the bottom of support bracket 150 and spike stop 146. Spring 148 allows for the head of spike 142 to be partially recessed in aperture 154 when spike 142 is not in use. Spike stop 146 allows for this recess without spring 148 fully ejecting spike 142. It is appreciated by one of skill in the art that spike stop 146, spring 148, gap 147, and spike 142 may be of various lengths and that the head of spike 142 does not have to be recessed in aperture 154.

FIG. 1 also shows optional extension 160. This optional extension protrudes from connection means 140 in a direction different from back spacer member 110 and support member 120. The purpose of extension 160 will be addressed in the third exemplary embodiment.

FIG. 2 shows a side view of siding tool 100 with a strip of siding 210 and a second strip of siding 220 to be installed. FIG. 2 also shows spike 142 in its inward position, such as into a building wall. As seen in FIG. 2, back spacer edge 112 is disposed against the top edge surface of a strip of siding 210. The length between back spacer edge 112 and ledge 125 of support member 120, namely spacing distance 202, can be of any predetermined length that would be appropriate for the desired lap siding overlap. It also may be adjustable by configuring the tool to allow for on-site adjustment of the length of back spacer member 110 and/or support member 120. Also shown in FIG. 2 is second strip of siding 220 disposed between ledge 125 and a edge 156 of support member 120 as defined by support length 204.

Support length 204 may be of any length to fit a desired piece of siding. Support member 120 of a given length 204 can support siding of various sizes because it is not necessary that the siding have a length equal to support length 204. For example, in FIG. 2 the second piece of siding 220 is shown to be the same height as length 204. However, the second piece of siding 220 could be of any height that would allow ledge 125 of support member 120 and back spacer member 110 to partially support the second piece of siding 220. The second piece of siding 220 does not have to press against edge 156 as long as the aforementioned criteria is met. This quality allows length 204 to be one predetermined length, yet still allow siding of multiple lengths to be used with the tool without having to adjust length 204. However, in an alternate embodiment, support member 120 may be adapted to be adjustable. This alternate configuration would allow for an even greater variety of heights of siding to be accommodated by the siding tool.

Figure 3:
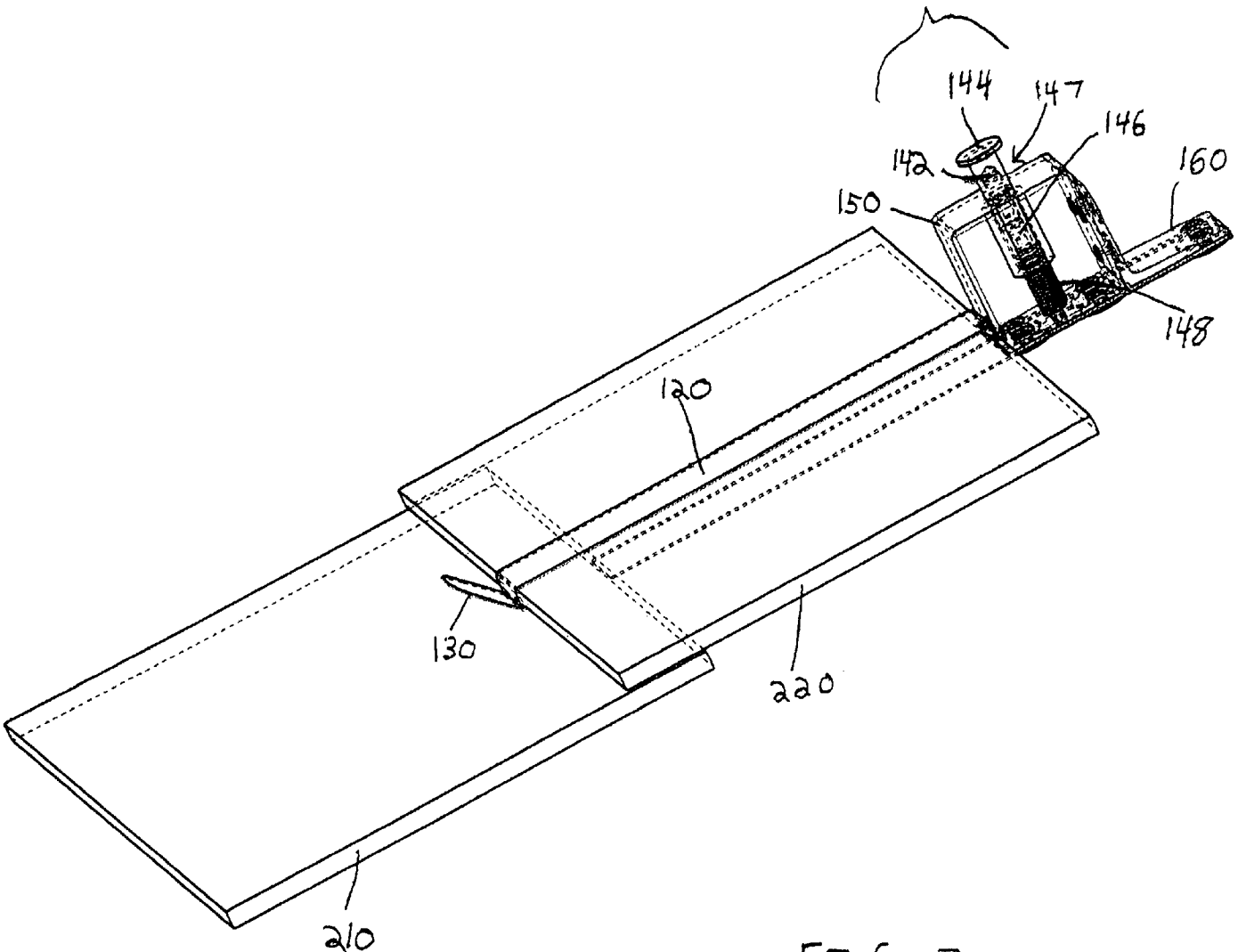
FIG. 3 is a perspective view of the tool in use to show the front features with parts normally not visible in shadow.
Figure 4:
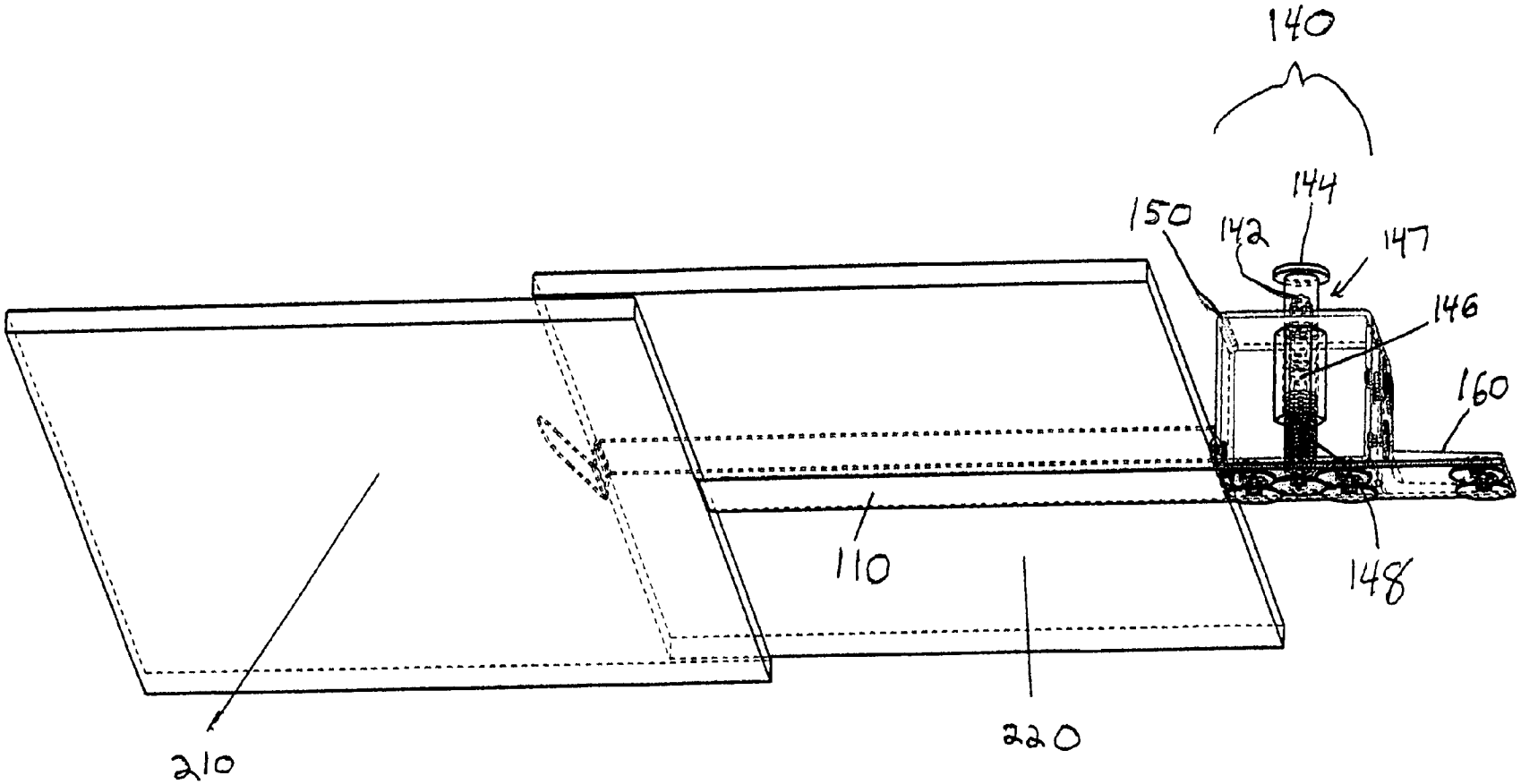
FIG. 4 is a perspective view of the tool in use to show the back features with parts normally not visible in shadow.
Figure 5:
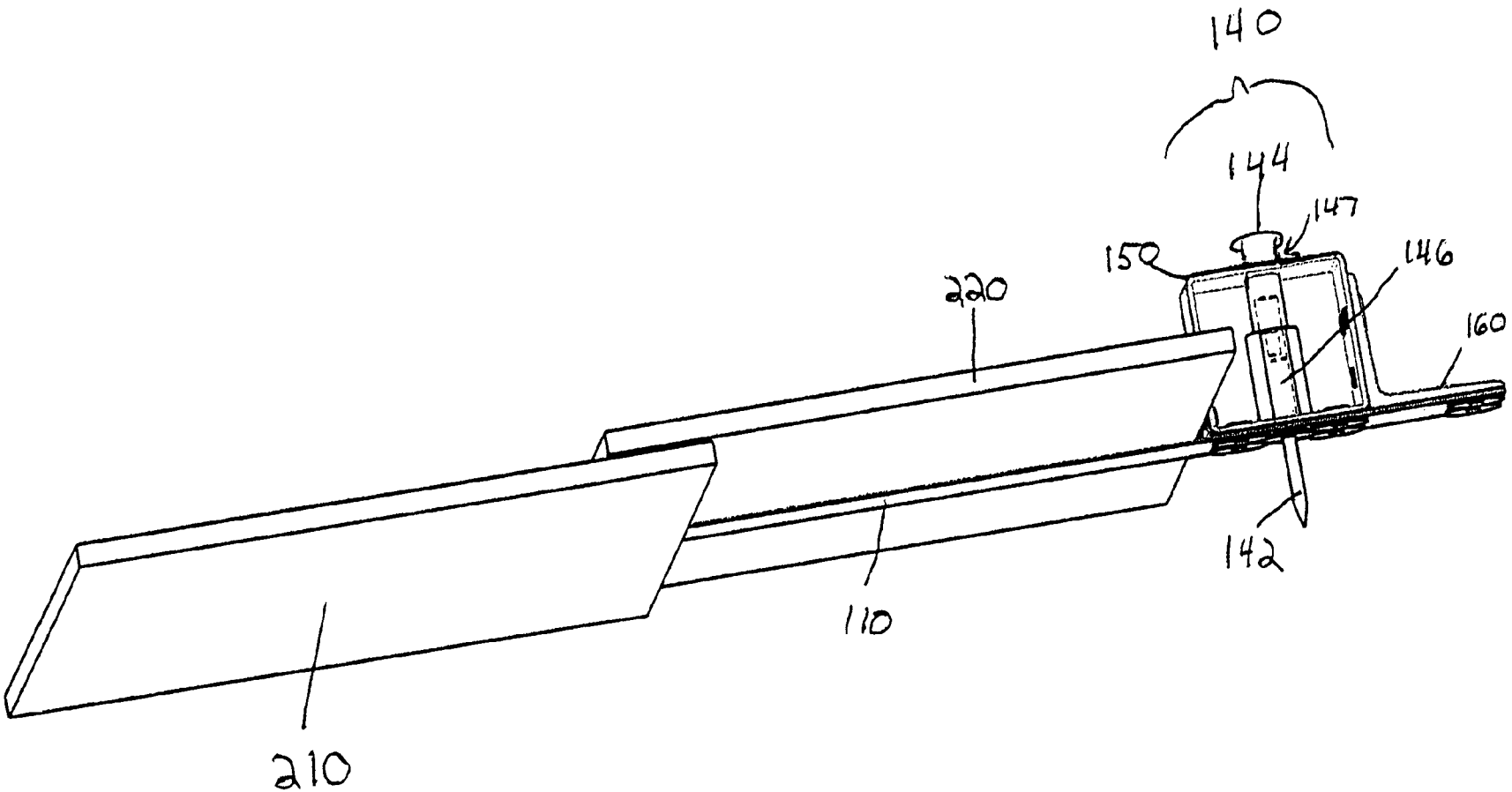
FIG. 5 is a perspective view of the tool in use to show the back features.
Figure 6:
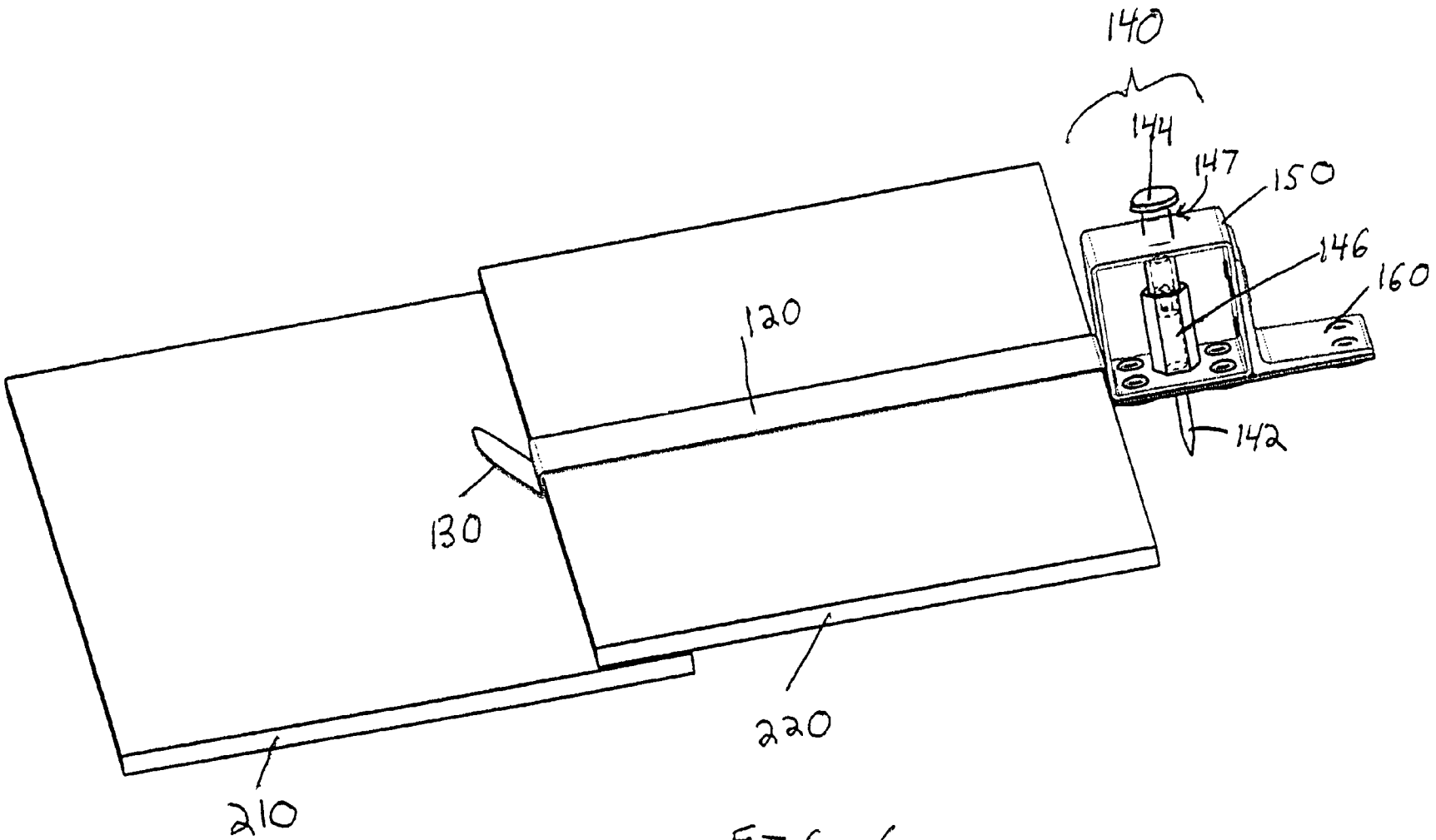
FIG. 6 is a perspective view of the tool in use to show the front features.

FIGS. 3, 4, 5 and 6 are alternate views of that which is shown in FIG. 2. FIG. 3 is a perspective view of the tool in use to show the front features with parts normally not visible in shadow. FIG. 4 is a perspective view of the tool in use to show the back features with parts normally not visible in shadow. FIG. 5 is a perspective view of the tool in use to show the back features. FIG. 6 is a perspective view of the tool in use to show the front features.

Figure 7A:
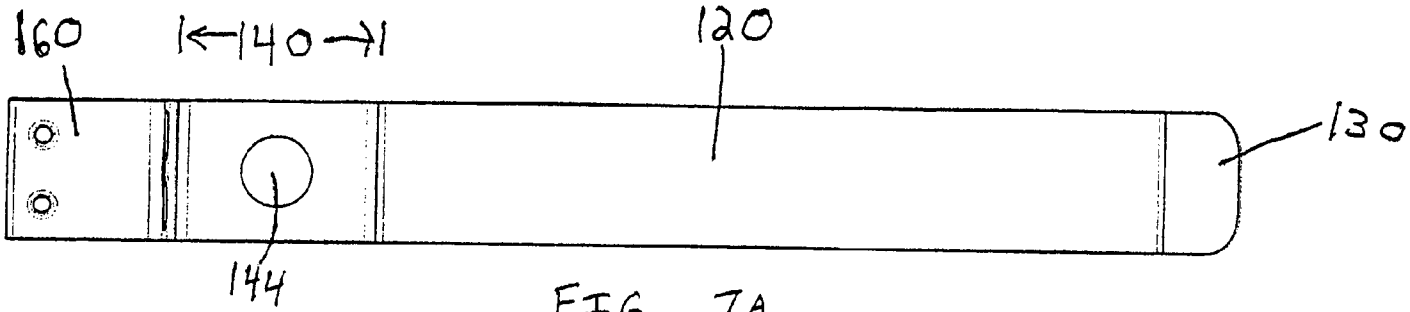
FIG. 7A is a top view of the tool.
Figure 7B:
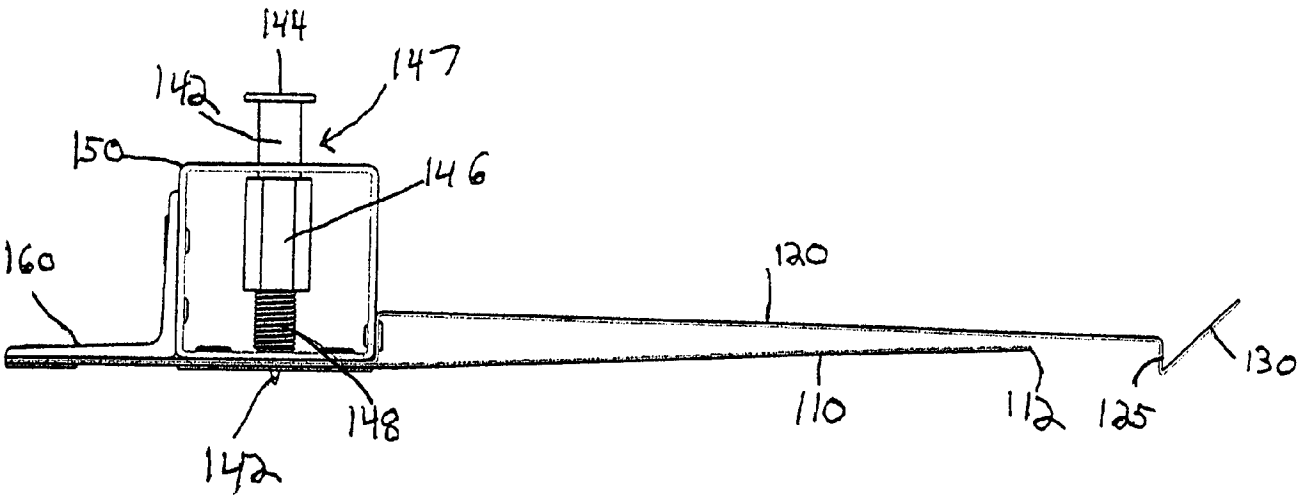
FIG. 7B is a side view of the tool.
Figure 7C:
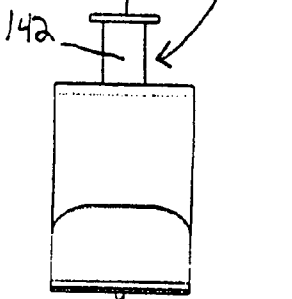
FIG. 7C is a right-side view of the tool.

FIGS. 7A, 7B and 7C are alternate views of what is shown in FIG. 1. FIG. 7A is a top view of the tool. FIG. 7B is a side view of the tool. FIG. 7C is a right-side view of the tool.

Figure 8:
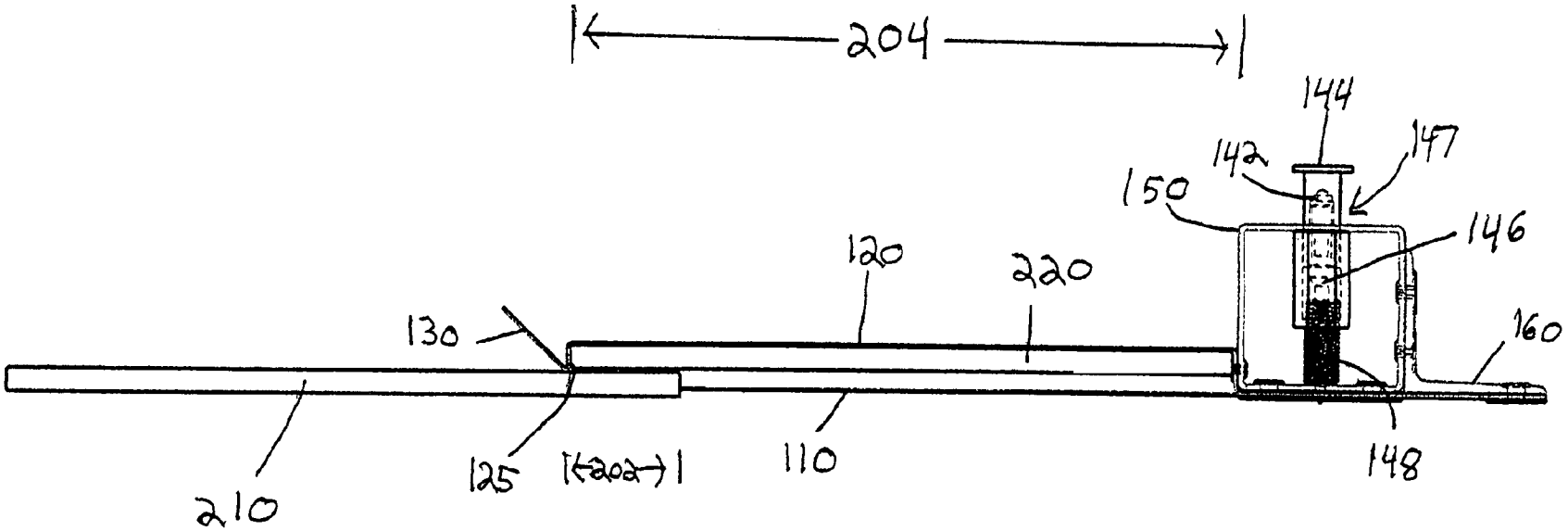
FIG. 8 is a side view of the tool in use.

FIG. 8 is similar to FIG. 2, but shows spike 142 in its rested position. When spike 142 is not in use, spring 148 applies a force against spike stop 146 which keeps the spike retracted. Gap 147 is larger when the spike is retracted, compared to when the spike is fully extended in its inward position.

Figure 9:
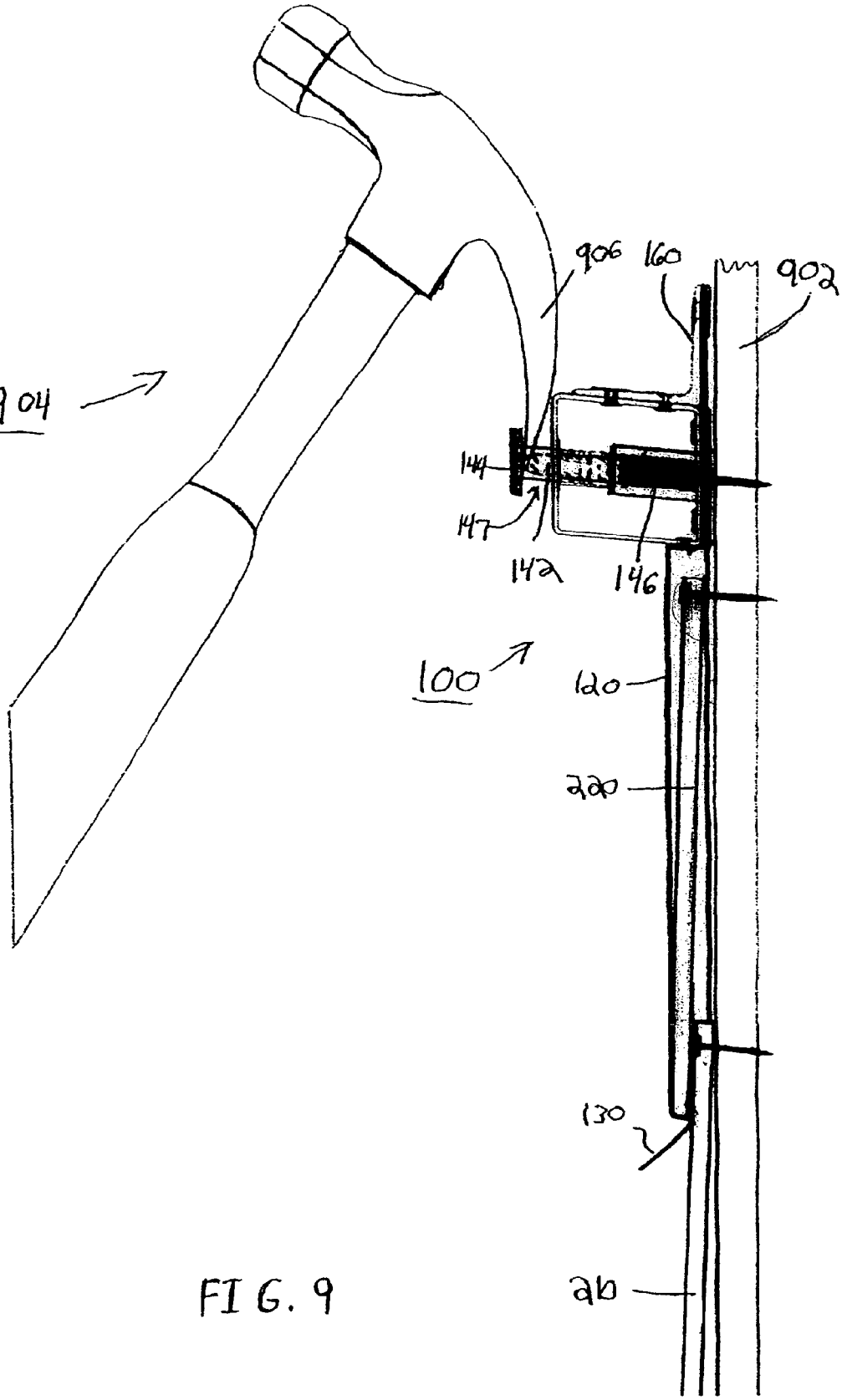
FIG. 9 is a side view of the tool in use and ready to be detached from a wall.

FIG. 9 is a side view of the tool in use and ready to be detached from a wall. As an example, hammer 904 is shown removing connection means 140 by placing hammer claw 906 into gap 147 to move spike head 144 away from support bracket 150 thereby removing spike 142 from wall 902.

Figure 10:
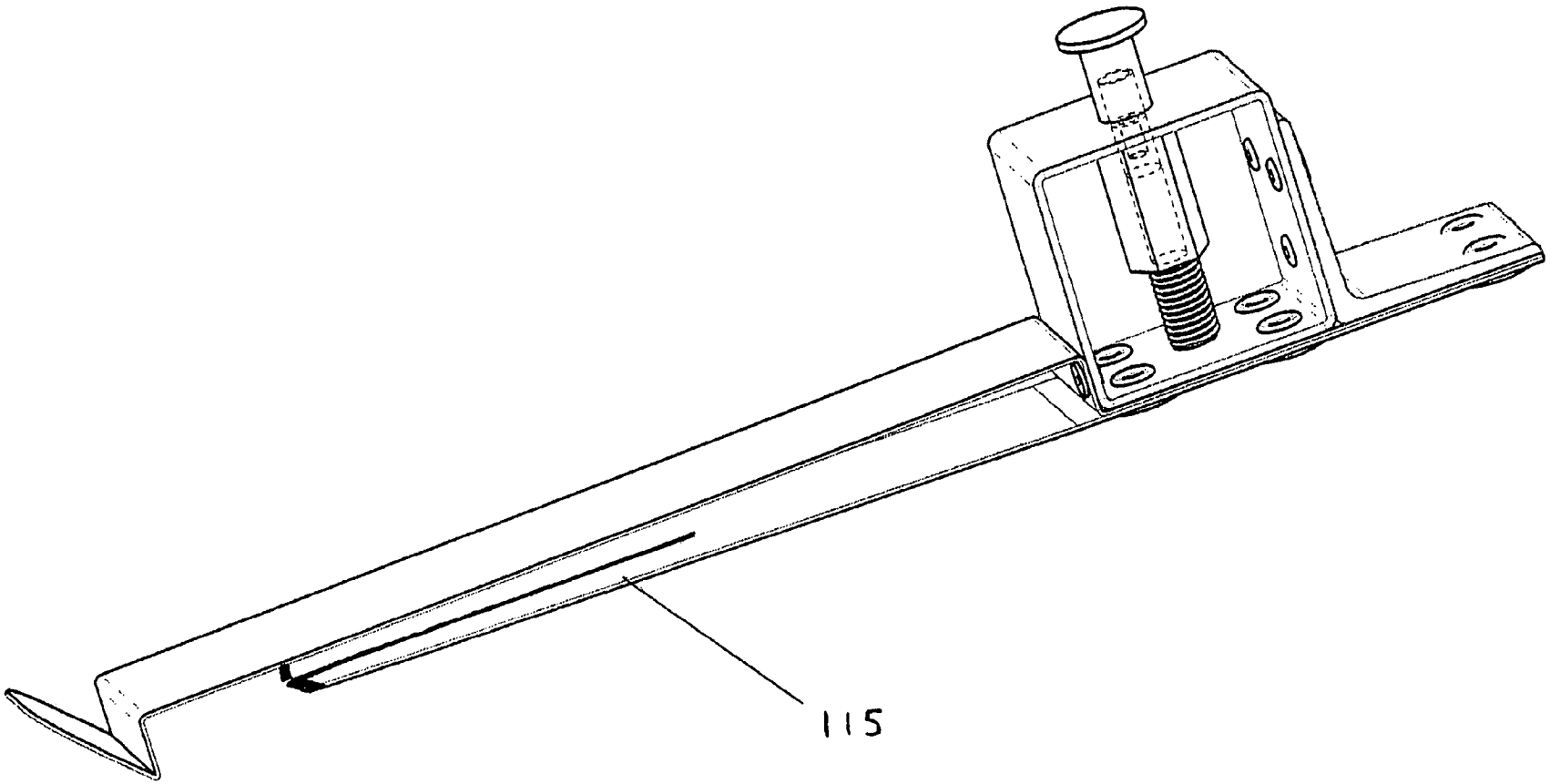
FIG. 10 is a perspective view of an embodiment of the tool having a lengthwise slit along the back spacer member.
Figure 11:
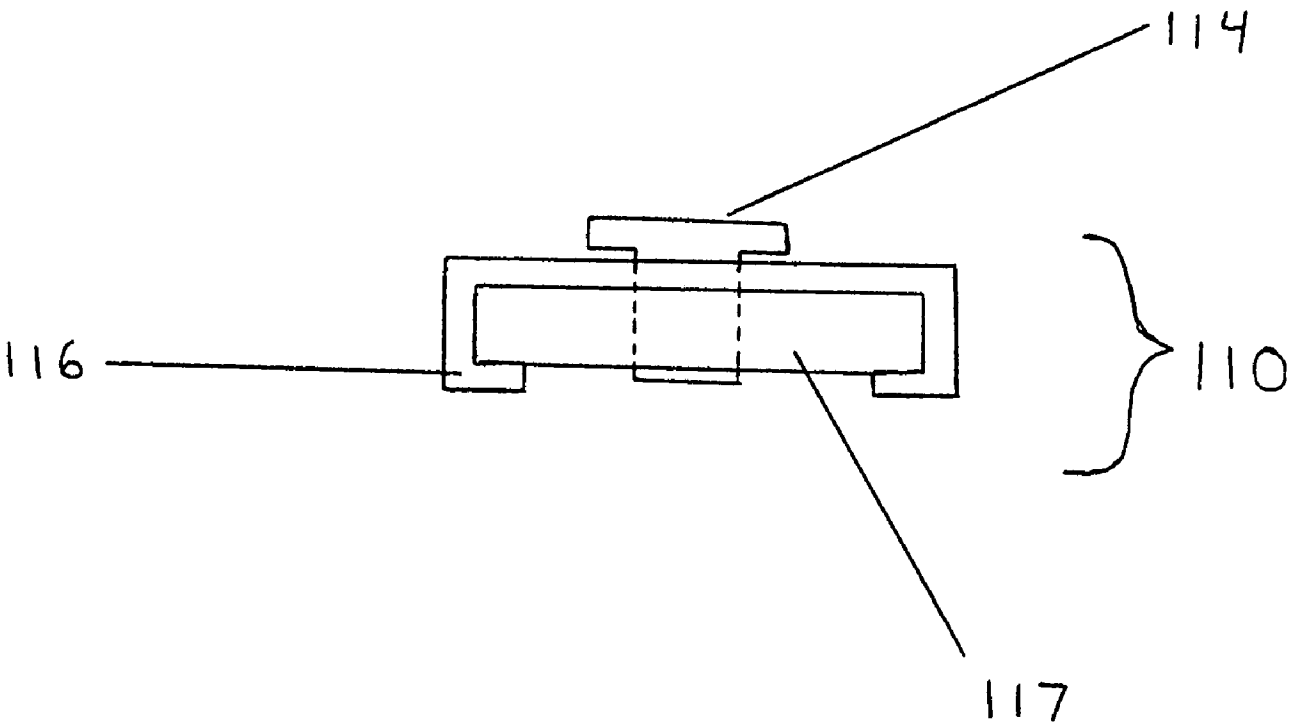
FIG. 11 is a cross-sectional view of an alternative embodiment of an adjustable back spacer member.

FIG. 10 is a perspective view of the tool with a lengthwise slit 115 extending from the bottom portion of the back spacer member. FIG. 11 is a cross-sectional view of the back spacer member with a fastening means 114 to adjust the length of back spacer member. The back spacer member also includes a guide member 116 and a sliding member 117 that can be adjusted to a desired length.

In one embodiment, such as is shown in FIG. 9, back spacer member 110 and support member 120 are attached to connection means 140. Connection means 140 consists of a flat plate of material with aperture 154. Support member 120 has ledge 125 for supporting a strip of siding. After a strip of siding 210 has been placed on a wall (e.g., wall 902), spacer edge 112 is placed on the top edge of the strip of siding 210. The siding tool 100 is then fastened to wall 902 by anchoring means 142 that would support all or part of the weight of siding. Depending on the length and weight of the siding, more than one tool may be used to correctly align the second strip of siding 220. If more than one tool is used, the process mentioned above is repeated until the necessary number of siding tools 100 have been put into position. Once the siding tools 100 are in position, the next strip of siding 220 is slid between back spacer member 110 and support member 120 until the bottom of the second strip of siding is rested on ledge 125. The second strip of siding 220 is then fastened to wall 902. Once the strip of siding is in place, the anchoring means is retracted from the wall 902 and the siding tool 100 is removed after ledge 125 is cleared from the bottom edge of the second strip of siding.

As seen in FIG. 7B, back spacer member 110 and support member 120 are tapered towards one another. This taper allows a piece of siding to be held in place on ledge 125 of siding tool 100. This aspect allows the tool to be used in the aforementioned manner. However, this is not the only manner in which the tool may be used.

In a second exemplary embodiment, it is also possible to attach siding tool 100 to a second piece of siding 220 before siding tool 100 is anchored to wall 902. For example, before attaching siding tool 100 to wall 902, one or more siding tools (the number of tools used depends on the length of siding) would be attached to the second piece of siding 220. The second piece of siding 220 would be slid between support member 120 and back spacer member 110. After the second piece of siding 220 is supported by ledge 125, it would be lifted to the approximate spot where the bottom edge 112 of back spacer member 110 would be used to get the desired amount of overlap. Once the second piece of siding 220 is in place, the siding tools would be anchored to the wall 902. Then the second piece of siding 220 would be fastened to the wall 902. Finally, the siding tools would be detached from wall 902 and removed from the piece of siding that was just put into place. These last steps could be accomplished by any means previously stated.

In a third exemplary embodiment, as illustrated in FIG. 1, connection means 140 consists of a support bracket 150 housing anchoring means, spike 142, spring 148, and spike stop 146. This configuration of the connection means 140 allows for the tool to be used without any additional materials and with a minimal number of additional tools (e.g., only a hammer). Spacer edge 112 is placed on a previous strip of siding (already hung). After placement, spike 142 is forced into a wall (e.g., wall 902, as shown in FIG. 9) by any means that would provide enough force for spike 142 to pierce wall 902 and be driven into wall 902 until spike stop 146 prevents the spike from further entry. Once spike 142 is fully embedded in wall 902, gap 147 is left, which later, in addition with spike head 144, assists in the removal of spike 142 from the wall 902 (as seen in FIG. 9). Once one or more siding tools 100 have been fastened to wall 902; the second strip of siding 220 is slid in between back spacer member 110 and support member 120 until the bottom edge of the second strip of siding 220 is resting on ledge 125. After the second strip of siding 220 has been fastened to wall 902, spike 142 is retracted from wall 902. Spike 142 can be retracted by any means that would provide enough torque to remove spike 142 from wall 902 (e.g., claw end of hammer can be slid into gap 147 and then pried forward, as shown in FIG. 9). In this exemplary embodiment, the siding tool 100 may have an extension 160. Extension 160 helps keep siding tool 100 in place by providing leverage against wall 902 to which the tool is attached and thereby provides a larger moment arm for prying the tool away from the wall during removal. After spike 142 has been retracted from wall 902, tab 130 is used to clear ledge 125 from the siding. Lastly, siding tool 100 is pulled up or sideways out from the strip of siding.

In a fourth exemplary embodiment, the back spacer member and the support member are adjustable. For example, the back spacer member is made out of two pieces of metal that are bolted together. One of the pieces has a slit in the center that allows the bolt to be tightened at various lengths. This configuration would allow the spacing distance to be variable. In a similar manner, the support member could be made adjustable, which would allow for the support length to be variable. By the support length being variable, not only could different heights of siding be accommodated by the siding tool, it could be used in conjunction with the length of the back spacer member to have a broader range of spacer distances. It is appreciated by one of skill in the art that there are various ways in which the back spacer member and the support member could be made adjustable and the present invention is not limited to this embodiment.

In another embodiment as seen in FIG. 10, siding tool 100 has a back spacer member 110 with a slit extending lengthwise along the bottom portion of the back spacer member, the slit dividing the bottom portion into two lengthwise portions. The inside edges of the two lengthwise portions are tapered towards the support member and allow less friction between the second piece of siding and the back spacer member. This allows for easier removal of the siding tool from the wall and enhanced grip on the top edge of a piece of siding.

In an alternative embodiment as seen in FIG. 11, the siding tool has a back spacer member 110 with a fastening means 114 to adjust the length of the back spacer member. In this embodiment, the back spacer member also includes a guide member 116 and a sliding member 117. The guide member is fixed to the connection means, and guides the sliding member 117 so that the sliding member remains stable while adjusting the back spacer member to a desired length. In one embodiment, the guide member has a slot which allows relative movement between the pieces when fastening means 114 is not secured. In another embodiment, both the guide member and the sliding member have a plurality of apertures, so that fastening means 114 can be fastened through an aperture on the guide member and an aperture on the extension. Thus, the fastening means can fix the sliding member to the guide member at any desired length. It is appreciated by one of skill in the art that there are various ways in which the fastening means 114 can fix the guide member 116 and the sliding member 117 to a desired length. As such, in this embodiment, the fastening means include, but are not limited to pins, screws, or bolts.

Although the present invention has been particularly described in conjunction with specific preferred embodiments, it is evident that many alternatives, modifications, and variations will be apparent to those skilled in the art. It is therefore contemplated that the appended claims will embrace any such alternatives, modifications, and variations as falling within the true scope and spirit of the present invention.

What is claimed:

1. A lap siding installation device for spacing and applying lap siding to a surface, comprising:

anchoring means for releasably anchoring said device to a surface;

connection means to house the anchoring means;

a first elongate member having a length extending from the connection means; and a second elongate member extending from the connection means in substantially the same direction as the first member, said second elongate member having a length greater than the length of the first member, and a protrusion extending toward the first elongate member, the protrusion comprising a ledge to receive and hold a piece of lap siding between the first and second elongate member, wherein the anchoring means is a spike having a spike head, the spike passing through the connection means, the first elongate member, and the second elongate member.

2. The device according to claim 1, wherein the lap siding installation device further comprises an extension to provide leverage for removing the device.

3. The device according to claim 1, wherein the second elongate member also comprises a tab extending in a direction away from the first elongate member to remove the ledge from a piece of lap siding.

4. The device according to claim 1, wherein the connection means comprises a support bracket that couples the first and second elongate members.

5. The device according to claim 1, wherein the anchoring means is a spike having a spike head, the spike being moveable between an a rest position and an inward position, the spike also including a spike stop that provides a distance between the connection means and the spike head when the spike is moved to its inward position.

6. The device according to claim 1, wherein the anchoring means is a spike including a spike head and a spike stop, the spike also having a spring disposed between the spike stop and connection means.

7. The device according to claim 1, wherein the first elongate member comprises a bottom edge to space overlapping pieces of siding.

8. A lap siding installation device for spacing and applying lap siding to a surface, comprising:

anchoring means for releasably anchoring said device to a surface;

connection means to house the anchoring means;

a first elongate member having a length extending from the connection means, wherein the first elongate member has a slit extending lengthwise along a bottom portion of the elongate member, the slit dividing the bottom portion into two lengthwise portions; and a second elongate member extending from the connection means in substantially the same direction as the first member, said second elongate member having a length greater than the length of the first member, and a protrusion extending toward the first elongate member, the protrusion comprising a ledge to receive and hold a piece of lap siding between the first and second elongate member.

9. A lap siding installation device for spacing and applying lap siding to a surface, comprising:

anchoring means for releasably anchoring said device to a surface;

connection means to house the anchoring means;

a first elongate member having a length extending from the connection means, wherein the first elongate member has two lengthwise portions, the two lengthwise portions having inside edges that are slightly tapered towards the second elongate member; and a second elongate member extending from the connection means in substantially the same direction as the first member, said second elongate member having a length greater than the length of the first member, and a protrusion extending toward the first elongate member, the protrusion comprising a ledge to receive and hold a piece of lap siding between the first and second elongate member.

10. The device according to claim 1, wherein the first and second elongate members are tapered toward each other.

11. The device according to claim 1, wherein at least one of the first and second elongate members has an adjustable length.

12. The device according to claim 1, wherein at least one of the first elongate member, the second elongate member, and the connection means is polymeric.

13. The device according to claim 1, wherein at least one of the first elongate member, the second elongate member, and the connection means is metallic.

14. The device according to claim 8, wherein the anchoring means is a spike having a spike head, the spike being moveable between an at rest position and an inward position, the spike also including a spike stop that provides a distance between the connection means and the spike head when the spike is moved to its inward position.

15. The device according to claim 8, wherein the anchoring means is a spike including a spike head and a spike stop, the spike also having a spring disposed between the spike stop and connection means.

16. The device according to claim 8, wherein the first elongate member comprises a bottom edge to space overlapping pieces of siding.

17. The device according to claim 8, wherein at least one of the first and second elongate members has an adjustable length.

18. The device according to claim 8, wherein the first and second elongate members are tapered toward each other.

19. The device according to claim 9, wherein the anchoring means is a spike having a spike head, the spike being moveable between an at rest position and an inward position, the spike also including a spike stop that provides a distance between the connection means and the spike head when the spike is moved to its inward position.

20. The device according to claim 9, wherein the anchoring means is a spike including a spike head and a spike stop, the spike also having a spring disposed between the spike stop and connection means.

21. The device according to claim 9, wherein the first elongate member comprises a bottom edge to space overlapping pieces of siding.

22. The device according to claim 9, wherein at least one of the first and second elongate members has an adjustable length.

* * * * *